US009522810B2

(12) United States Patent
Chou et al.

(10) Patent No.: US 9,522,810 B2
(45) Date of Patent: Dec. 20, 2016

(54) OVERHEAD CRANE

(71) Applicant: Taiwan Semiconductor Manufacturing Company Limited, Hsin-Chu (TW)

(72) Inventors: You-Hua Chou, Hsinchu (TW); Ta-Yung Lee, Taipei (TW); Chiao-Ping Cheng, Taichung (TW); Ying Chi Wu, Taipei (TW)

(73) Assignee: Taiwan Semiconductor Manufacturing Company Limited, Hsin-Chu (TW)

( * ) Notice: Subject to any disclaimer, the term of this patent is extended or adjusted under 35 U.S.C. 154(b) by 304 days.

(21) Appl. No.: 14/157,686

(22) Filed: Jan. 17, 2014

(65) Prior Publication Data

US 2015/0203336 A1 Jul. 23, 2015

(51) Int. Cl.

| | |
|---|---|
| ***B66C 5/02*** | (2006.01) |
| ***B66C 19/00*** | (2006.01) |
| ***B66C 17/00*** | (2006.01) |
| ***B66C 15/00*** | (2006.01) |

(52) U.S. Cl.

CPC ..... *B66C 17/00* (2013.01); *B66C 15/00* (2013.01); *B66C 5/02* (2013.01); *B66C 19/00* (2013.01)

(58) Field of Classification Search

CPC ..... B66C 5/00; B66C 5/02; B66C 5/04; B66C 5/06; B66C 17/00–17/26; B66C 19/00–19/02; B66C 15/00; B66C 15/06; B66C 15/065

USPC ..... 212/312, 324

See application file for complete search history.

(56) References Cited

U.S. PATENT DOCUMENTS

| | | | | |
|---|---|---|---|---|
| 4,460,389 | A * | 7/1984 | Baum | B04C 5/28 266/157 |
| 5,337,908 | A * | 8/1994 | Beck, Jr. | A61G 7/1015 104/126 |
| 5,642,822 | A * | 7/1997 | Monzen | B66C 13/46 212/275 |
| 2010/0089210 | A1* | 4/2010 | Lanciaux | B23Q 11/0046 83/39 |
| 2013/0291332 | A1* | 11/2013 | Nakao | B08B 5/023 15/347 |

FOREIGN PATENT DOCUMENTS

JP 2014105082 * 6/2014

* cited by examiner

*Primary Examiner* — Sang Kim
*Assistant Examiner* — Juan Campos, Jr.
(74) *Attorney, Agent, or Firm* — Cooper Legal Group, LLC

(57) ABSTRACT

One or more overhead cranes are provided. The overhead cranes include a first horizontal rail having a first end and a second end, a second horizontal rail having a third end and a fourth end, a first post connected to the first end of the first horizontal rail, a second post connected to the second end of the first horizontal rail, a third post connected to the third end of the second horizontal rail, a fourth post connected to the fourth end of the second horizontal rail and a cross member extending from the first horizontal rail to the second horizontal rail. The cross member includes a center span section, a first side arm and a second side arm. In some embodiments, the center span section is trapezoidialy shaped. In some embodiments, the overhead crane includes a vacuum system.

20 Claims, 5 Drawing Sheets

OVERHEAD CRANE

BACKGROUND

In semiconductor manufacturing, items that are relatively heavy, such as processing tools, parts and other manufacturing materials, are used in various manufacturing units in a working bay, and thus have to be moved among, between or around the same. Often fabrication employees or engineers manually perform the movement of such items.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
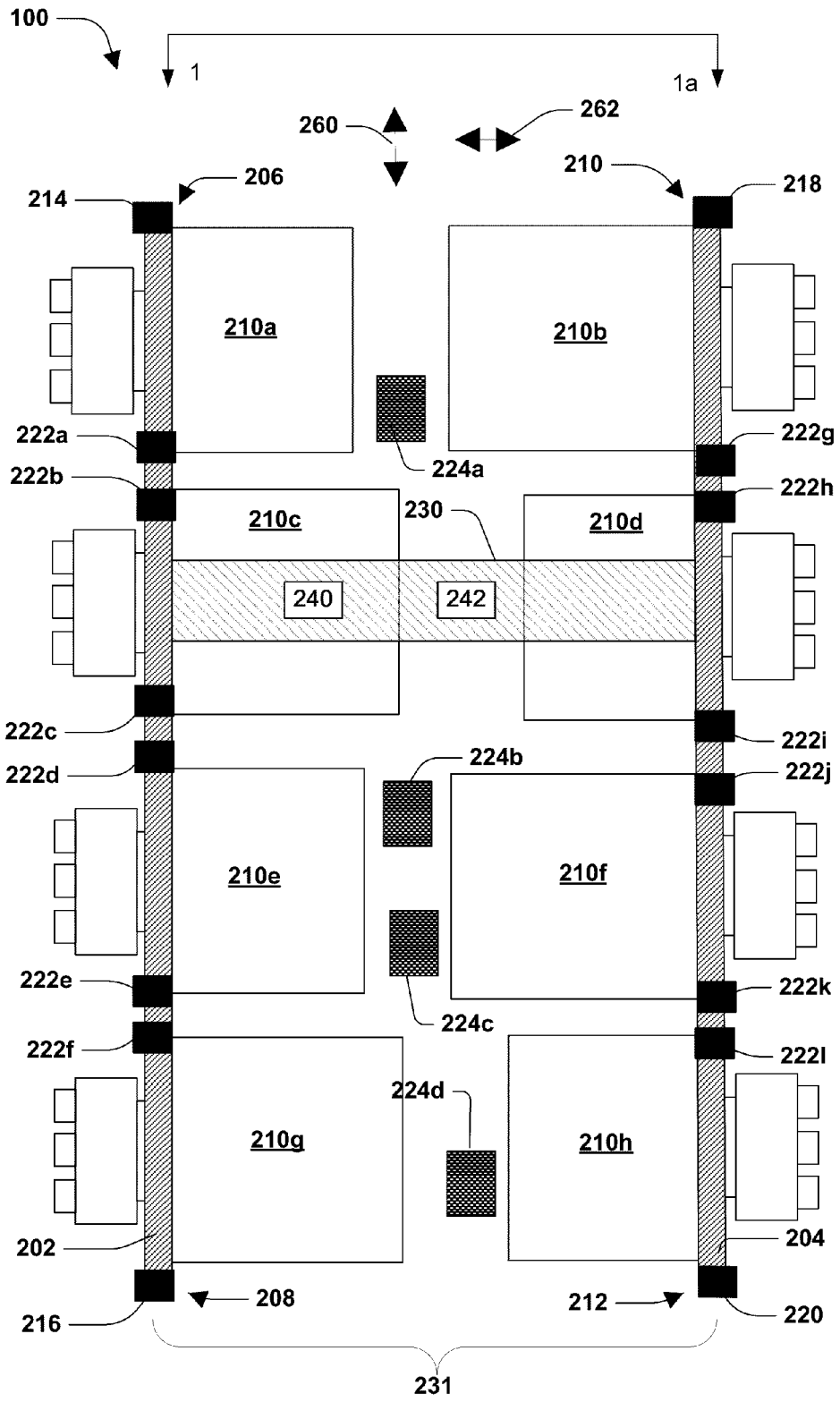
FIG. 1 is an illustration of a top down view of an overhead crane in accordance with some embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

One or more overhead cranes are provided herein. In some embodiments, the overhead cranes are configured to be used in the production of a semiconductor, such as those that utilize a 450 mm wafer. In some embodiments, the overhead crane is configured to detect an earthquake and help mitigate the chance of an accidental collapse.

Turing now to FIG. 1, a top down view of an overhead crane 100 according to some embodiments is provided. In some embodiments, the overhead crane 100 includes at least one of a first horizontal rail 202 or a second horizontal rail 204. In some embodiments, the first horizontal rail 202 includes at least one of a first end 206 or a second end 208. In some embodiments, the second horizontal rail 204 includes at least one of a third end 210 or a fourth end 212. In some embodiments, the second horizontal rail 204 is positioned parallel to and spaced apart from the first horizontal rail 202. In some embodiments, at least one of the first horizontal rail 202 or the second horizontal rail 204 includes a track system. In some embodiments, the track system includes at least one of a ball bearing, a wheel set, a path or a groove. In some embodiments, the track system defines movement along at least one of the first horizontal rail 202 or the second horizontal rail 204. In some embodiments, at least one of the first horizontal rail 202 or the second horizontal rail 204 includes at least one of aluminum or steel.

In some embodiments, at least one of a first post 214, a second post 216, a third post 218 or a fourth post 220 is connected to at least one of the first end 206, the second end 208, the third end 210 or the fourth end 212. In some embodiments, the first post 214 is connected to the first end 206, the second post 216 is connected to the second end 208, the third post 218 is connected to the third end 210 and the fourth post 220 is connected to the fourth end 212. In some embodiments, additional posts, such as post **222*a*-222*l*, are positioned between at least one of the first post 206 and the second post 208 or the third post 210 and the fourth post 212. In some embodiments, at least one of the additional post 222*a*-222*l* provide additional support to at least one of the first horizontal rail 202 or the second horizontal rail 204. In some embodiments, at least one of the additional posts 222*a*-222*l* is used to increase the span of at least one of the first horizontal rail 202 or the second horizontal rail 204**.

In some embodiments, the posts **214-222*l* are placed on opposing sides of at least one of manufacturing units 210*a*-210*h*. In some embodiments, at least one of the manufacturing units 210*a*-210*h* includes at least one of a loadport, an equipment front end module (EFEM), a central handler or a process module. In some embodiments, at least one of the manufacturing units 210*a*-210*h*** is configured to manufacture a 450 mm wafer.

In some embodiments, a cross member 230 is disposed between the first horizontal rail 202 and the second horizontal rail 204. In some embodiments, the cross member 230 extends from the first horizontal rail 202 to the second horizontal rail 204. In some embodiments, the cross member 230 is configured to span at least part of a working bay. In some embodiments, the cross member 230 has a width 231. In some embodiments, the width 231 is adjustable to accommodate a redesign of the working bay. In some embodiments, the cross member 230 is configured to move along at least one of the first horizontal rail 202 or the second horizontal rail 204. In some embodiments, the cross member 230 is configured to move along a x axis illustrated by an arrow 260. In some embodiments, the cross member is connected to the track system. In some embodiments, the cross member 230 moves along the track system of at least one of the first horizontal rail 202 or the second horizontal rail 204.

In some embodiments, at least one of a first hoist 240 or a second hoist 242 is attached to the cross member 230. In some embodiments, at least one of the first hoist 240 or the second hoist 242 is configured to move along the cross member 230. In some embodiments, at least one of the first hoist 240 or the second hoist 242 is configured to move independently or in synchrony. In some embodiments, at least one of the first hoist 240 or the second hoist 242 moves along a y axis illustrated by an arrow 262. In some embodiments, at least one of the first hoist 240 or the second hoist 242 is configured to raise or lower at least one of manufacturing components 224*a*-224*d*. In some embodiments, at least one of the manufacturing components 224-224*d* includes at least one of a tool, a part or a manufacturing material. In some embodiments, the overhead crane 100 is configured to move at least one of the manufacturing components 224*a*-224*d* from one of the manufacturing units 210*a*-210*h* to another one of the manufacturing units 210*a*-210*h*. In some embodiments, the overhead crane 100 moves at least one of the manufacturing component 224*a*-224*d* along a non-uniform path to transfer the manufacturing component from one manufacturing unit, such as manufacturing unit 210*a*, to another manufacturing unit, such as manufacturing unit 210*h*.

Figure 2:
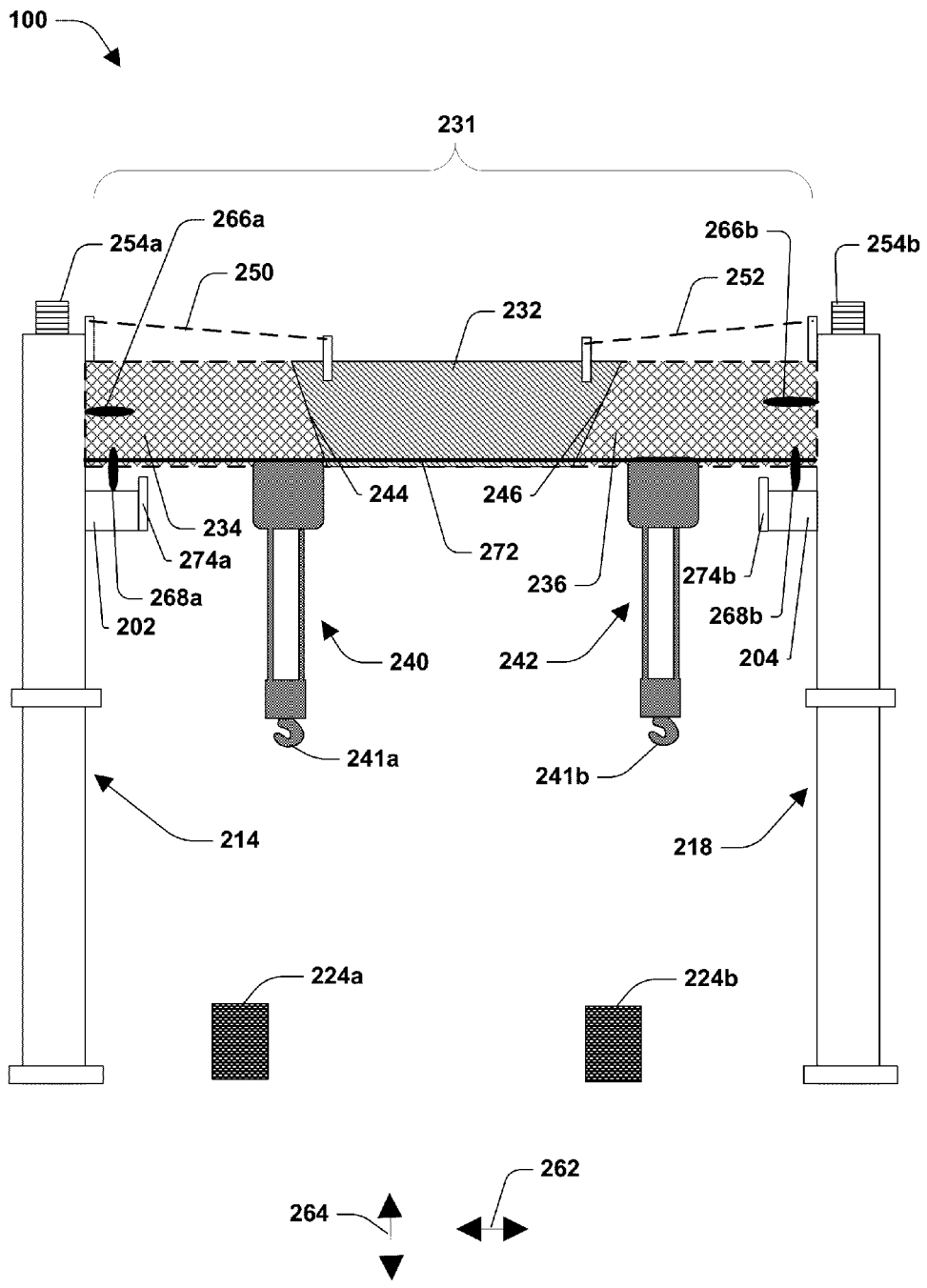
FIG. 2 is an illustration of a sectional view of an overhead crane in accordance with some embodiments.

Turning now to FIG. 2, a sectional view looking in to the embodiment of FIG. 1 from a perspective indicated by line 1-1*a* is provided. In some embodiments, the cross member 230 includes at least one of a center span section 232, a first side arm 234 or a second side arm 236. In some embodiments, at least one of the center span section 232, the first side arm 234 or the second side arm 236 includes at least one of aluminum or steal. In some embodiments, at least one of the center span section 232, the first side arm 234 or the second side arm 236 includes at least one of an aluminum rod or an aluminum tube.

In some embodiments, the center span section 232 has a first side 244 and a second side 246. In some embodiments, at least one of the first side 244 or the second side 246 is configured to extend into or over at least one of the first side arm 234 or the second side arm 236. In some embodiments, at least one of the first side 244 or the second side 246 abuts at least one of the first side arm 234 or the second side arm 236. In some embodiments, at least one of the first side arm 234 or the second side arm 236 is connected to or proximate to at least one of the first horizontal rail 202, the second horizontal rail 204, the first side 244 or the second side 246. In some embodiments, at least one of the first side arm 234 of the second side arm 236 is connected to at least one of the first horizontal rail 202 or the second horizontal rail 204 by contacting the track system. In some embodiments, the track system includes retain grooves 274*a*-274*b*. In some embodiments, the center span section is trapezoidialy shaped. In some embodiments, the trapezoidal shape of the center span section 232 increases the structural stability of the cross member 230. In some embodiments, the first side arm 234, the second side arm 236 and the center span section 230 are easily separated to accommodate a relayout of the working bay. In some embodiments, the center span section 232 is expanded, collapsed or replaced to increase or decrease the width 231 of the cross member 230.

In some embodiments, the overhead crane 100 includes at least one of a first cable stay 250*a* or a second cable stay 250*b*. In some embodiments, at least one of the cable stays 250*a*-250*b* connects at least one of the first side arm 234 or the second side arm 236 to the center span section 232. In some embodiments, at least one of the cable stays 250*a*-250*b* includes a rod, a chain, a strap or a cable. In some embodiments, at least one of the of the cable stays 250*a*-250*b* provides additional support or loading capacity to the cross member 230.

In some embodiments, the overhead crane 100 includes a truss suspension system. In some embodiments, the truss suspension system includes at least one of a connection means, a first truss suspension anchor 254*a* or a second trust suspension anchor 254*b*. In some embodiments, at least one of the truss suspension anchors 254*a*-254*b* is attached to at least one of the first horizontal rail 202, the second horizontal rail 204 or the posts 214-222*l*. In some embodiments, at least one of the truss suspension anchors 254*a*-254*b* is connected to at least one of a ceiling or wall (not illustrated). In some embodiments, at least one of the truss suspension anchors 254*a*-254*b* is connected to at least one of the ceiling or wall by the connection means (not shown), such as a cable or rod. In some embodiments, the truss suspension system protects against an accidental collapse by providing additional support. In some embodiments, the truss suspension system helps to prevent the collapse of the overhead crane 100 during an earthquake.

In some embodiments, the overhead crane 100 includes a retain wheel set. In some embodiments, the retain wheel set includes at least one of a first retain wheel 266*a* or a second retain wheel 266*b*. In some embodiments, the retain wheels 266*a*-266*b* are configured to provide horizontal support as the cross member 230 moves along at least one of the first horizontal rail 202 or the second horizontal rail 204. In some embodiments, the retain wheel set includes a plurality of retain wheels.

In some embodiments, at least one of the retain wheels 266*a*-266*b* is attached to at least one of the first horizontal rail 202, the second horizontal rail 204, the first side arm 234 or the second side arm 236. In some embodiments, at least one of the first side arm 234 or the second side arm 236 includes at least one of a first horizontal wheel housing or a second horizontal wheel housing. In some embodiments, at least one of the retain wheels 266*a*-266*b* is attached to at least one of the first side arm 234 or the second side arm 236 by at least one of the horizontal wheel housings. In some embodiments, the horizontal wheel housings are recessed into at least one of the first side arm 234 or the second side arm 236. In some embodiments, at least one of the horizontal wheel housings is attached to an outer surface of at least one of the first side arm 234 or the second side arm 236. In some embodiments, the horizontal wheel housings are configured to position at least one of the retain wheels 266*a*-266*b* between at least one of the first horizontal rail 202 or the second horizontal rail 204 and at least one of the first side arm 234 or the second side arm 236. In some embodiments, at least one of the retain wheels 266*a*-266*b* contacts the track system.

In some embodiments, the overhead crane 100 includes a moving wheel set. In some embodiments, the moving wheel set includes at least one of a first moving wheel 268*a* or a second moving wheel 268*b*. In some embodiments, the moving wheel set includes a plurality of moving wheels. In some embodiments, the moving wheels 268*a*-268*b* are configured to move the cross member 230 along at least one of the first horizontal rail 202 or the second horizontal rail 204. In some embodiments, the moving wheels 268*a*-268*b* move along the retain grooves 274*a*-274*b*. In some embodiments, the moving wheels 268*a*-268*b* are configured to provide vertical support as the cross member 230 moves along at least one of the first horizontal rail 202 or the second horizontal rail 204.

In some embodiments, at least one of the moving wheels 268*a*-268*b* is attached to at least one of the first horizontal rail 202, the second horizontal rail 204, the first side arm 234 or the second side arm 236. In some embodiments, at least one of the first side arm 234 or the second side arm 236 includes at least one of a first vertical wheel housing or a second vertical wheel housing. In some embodiments, at least one of the moving wheels 268*a*-268*b* is attached to at least one of the first side arm 234 or the second side arm 236 by at least one of the vertical wheel housings. In some embodiments, the vertical wheel housings are recessed into at least one of the first side arm 234 or the second side arm 236. In some embodiments, at least one of the vertical wheel housings is attached to an outer surface of at least one of the first side arm 234 or the second side arm 236. In some embodiments, the vertical wheel housings are configured to position at least one of the moving wheels 268*a*-268*b* between at least one of the first post 202, the third post 218, the first horizontal rail 202 or the second horizontal rail 204 and at least one of the first side arm 234 or the second side arm 236.

In some embodiments, the overhead crane 100 includes a conductive power supply system. In some embodiments, the conductive power supply system is contactless. In some embodiments, the conducive power supply system is configured to power a motor to move the cross member 230 along at least one of the first horizontal rail 202 or the second horizontal rail 204.

In some embodiments, the cross member 230 includes a hoist track 272. In some embodiments, at least one of the first hoist 240 or the second hoist 242 moves along the cross member 230 on the hoist track 272. In some embodiments, the hoist track 272 is connected to a hoist motor configured to move at least one of the first hoist 240 or the second hoist 242. In some embodiments, at least one of the first hoist 240 or the second hoist 242 moves along the cross member 230 along a y axis illustrated by an arrow 262.

In some embodiments, at least one of the first hoist 240 or the second hoist 242 includes at least one of a first attachment means 241*a* or a second attachment means 241*b*. In some embodiments, at least one of the first hoist 240 of the second hoist 242 moves at least one of the attachment means 241*a*-241*b* along a z axis illustrated by an arrow 264. In some embodiments, at least one of the attachment means 241*a*-241*b* is configured to attach to at least one of the manufacturing components 224*a*-224*b*.

Figure 3:
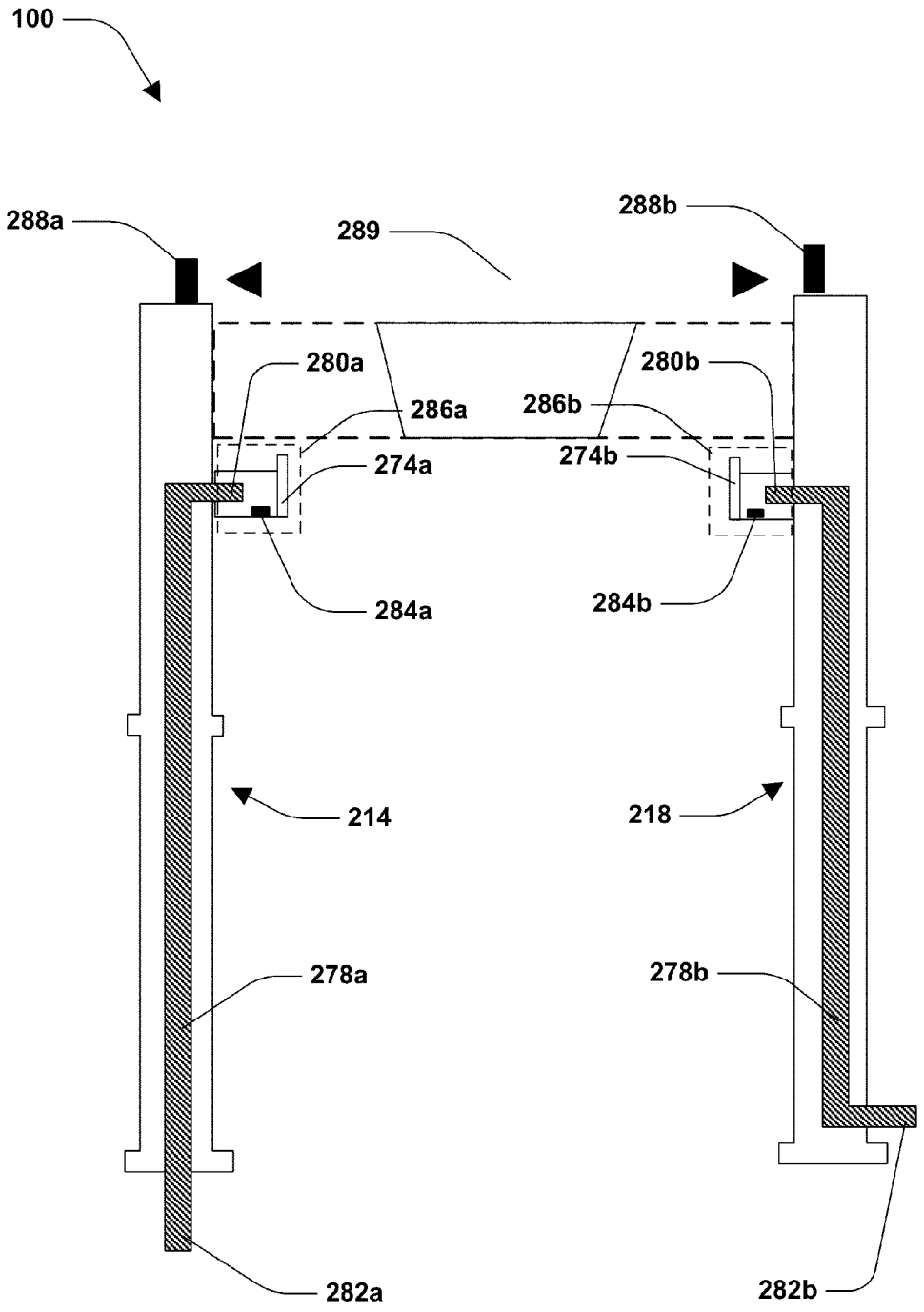
FIG. 3 is an illustration of a cross sectional view of an overhead crane in accordance with some embodiments.

Turning now to FIG. 3, a cross sectional view of the overhead crane 100 according to some embodiments is provided. In some embodiments, the overhead crane 100 includes a vacuum system. In some embodiments, the vacuum system includes at least one of vacuum pipelines 278*a*-278*b*, dust sensors 284*a*-284*b* or dust collectors 286*a*-286*b*.

In some embodiments, at least one of the first post 214 or the third post 218 includes at least one of the vacuum pipelines 278*a*-278*b*. In some embodiments, at least one of the vacuum pipelines 278*a*-278*b* is contained within at least one of the first post 214 or the third post 218. In some embodiments, at least one of the vacuum pipelines 278*a*-278*b* is positioned on an outer surface of at least one of the first post 214 or the third post 218. In some embodiments, at least one of the vacuum pipelines 278*a*-278*b* has at least one of inlets 280*a*-280*b* or outlets 282*a*-282*b*. In some embodiments, at least one of the inlets 280*a*-280*b* is positioned proximate the retain grooves 274*a*-274*b*. In some embodiments, at least one of the inlets 280*a*-280*b* collects dust from the retain grooves 274*a*-274*b*. In some embodiments, at least one of the outlets 282*a*-282*b* is positioned proximate a base of at least one of the first post 214 or the third post 218. In some embodiments, at least one of the outlets 282*a*-282*b* is connected to a vacuum pump.

In some embodiments, at least one of the dust sensors 284*a*-284*b* is positioned proximate at least one of the inlets 280*a*-280*b*. In some embodiments, the dust sensors 284*a*-284*b* are configured to detect the presence of dust, such as dust from at least one of the moving wheel set or the retain wheel set, and activate the vacuum system. In some embodiments, the duct collectors 286*a*-286*b* are positioned proximate the at least one of the retain groves 274*a*-274*b*, the inlets 280*a*-280*b* or the dust sensors 284*a*-284*b*. In some embodiments, the dust collectors 286*a*-286*b* are configured to collect dust generated by at least one of the moving wheel set or the retain wheel set. In some embodiments, the vacuum system is activated when the cross member 230 approaches at least one of the posts 214-222*l*. In some embodiments, the vacuum system minimizes contamination in the working bay.

In some embodiments, the overhead crane 100 includes a vibration detection system. In some embodiments, the vibration detection system includes vibration sensors 288*a*-288*b*. In some embodiments, the vibration sensors 288*a*-288*b* include at least one of laser guided sensors, infrared sensors, microwave motion sensors or ultrasonic motion sensors. In some embodiments, the vibration sensor 288*a* communicates with vibration sensor 288*b*. In some embodiments, the vibration sensors 288*a*-288*b* communicate via an optical signal 289. In some embodiments, when the optical signal 289 is disrupted, the vibration sensors alert a user. In some embodiments, when a vibration, such as from an earthquake, is detected, the vibration detection system halts the operation of the overhead crane 100. In some embodiments, at least one of the vibration sensors 288*a*-288*b* is configured to sense a vibration and halt operation of at least a portion of the overhead crane when the vibration exceeds a vibration threshold.

Figure 4:
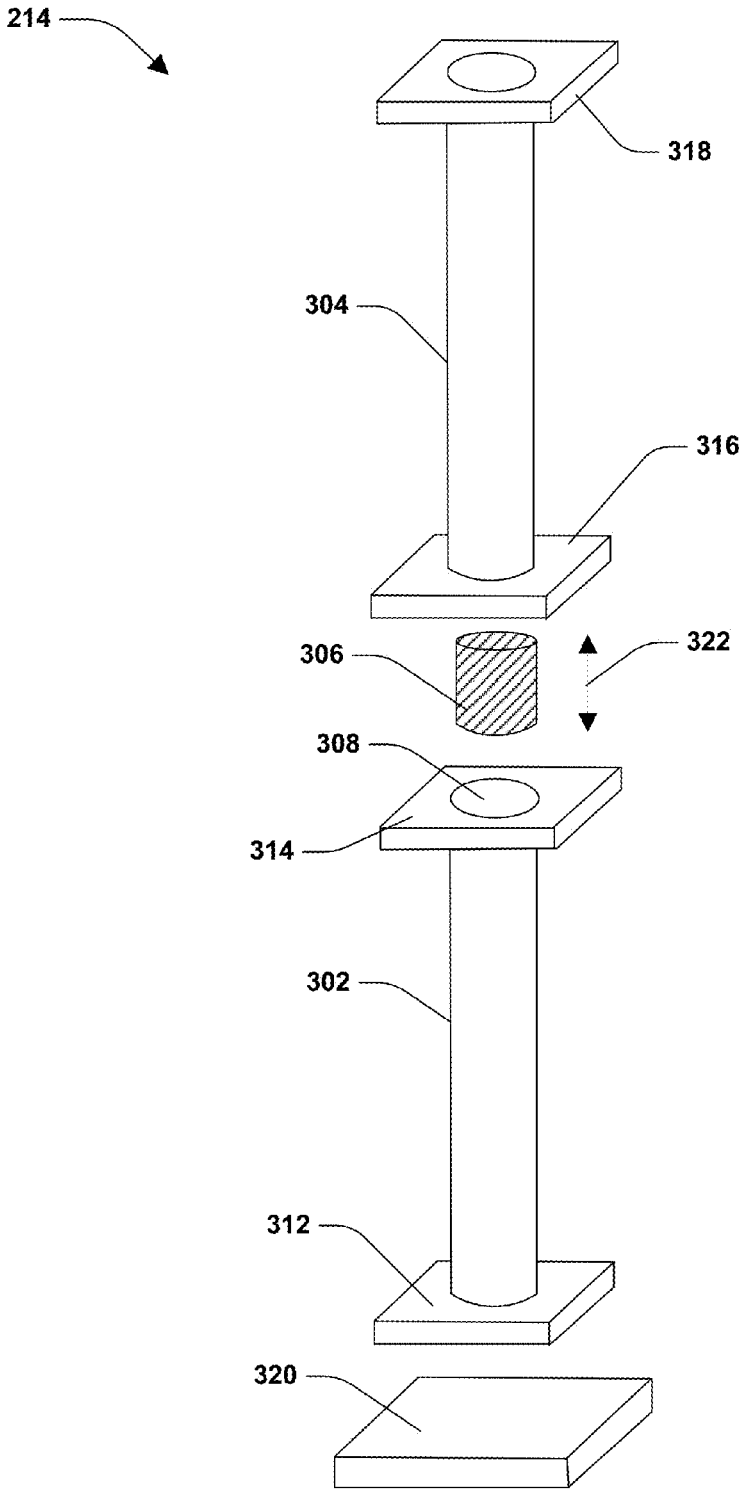
FIG. 4 is an illustration of a prospective view of a post in accordance with some embodiments.

Turning now to FIG. 4, a prospective view of the first post 214 according to some embodiments is provided. In some embodiments, the first post 214 includes at least one of a first post section 302, a second post section 304 or a coupling member 306. In some embodiments, at least one of the first post section 302 or the second post section 304 includes at least one of a first intersection joint (not shown), a second insertion joint 308, a third insertion joint (not shown) or a fourth insertion joint 310. In some embodiments, the coupling member 306 is inserted into at least one of the second intersection joint 308 or the third intersection joint. In some embodiments, the coupling member 306 is inserted into at least one of the second intersection joint 308 or the third intersection joint along the path illustrated by arrow 322. In some embodiments, the second post section 304 is positioned on top of the first post section 302. In some embodiments, the coupling member 306 couples the first post section 302 to the second post section 304.

In some embodiments, at least one of the first post section 302 or the second post section 304 includes at least one of a first intersection platform 312, a second intersection platform 314, a third intersection platform 316 or a fourth insertion platform 318. In some embodiments, the second intersection platform 314 contacts the third intersection platform 316. In some embodiments, the second intersection platform 314 is secured to the third intersection platform 316 by at least one of a clamp, a screw, a bolt or a weld. In some embodiments, at least one of the first intersection platform 312 or the first post 214 is anchored to a waffle slab 320. In some embodiments, the waffle slab 320 includes at least one of a concrete, a metal or a rubber.

Figure 5:
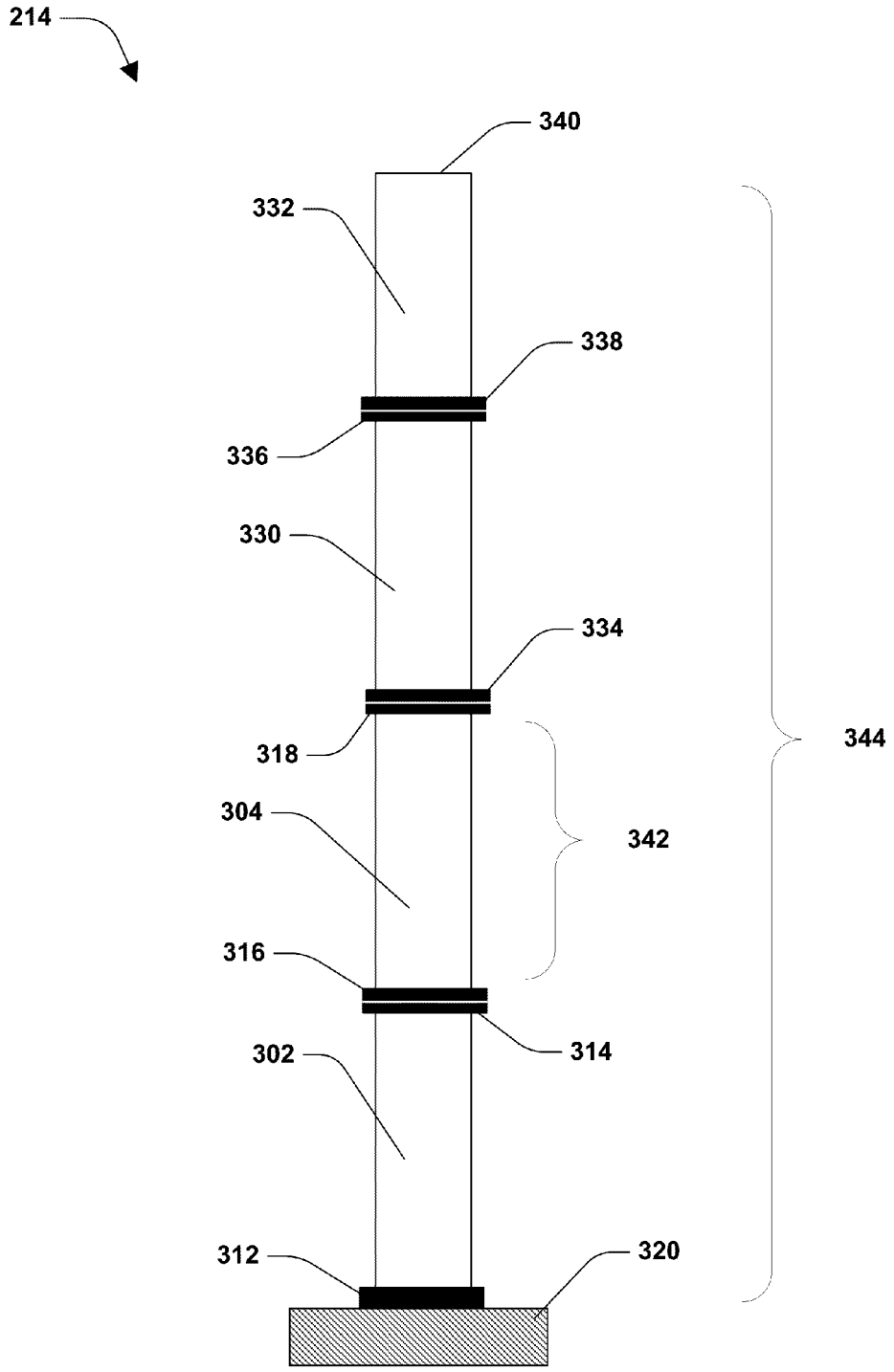
FIG. 5 is an illustration of a prospective view of a post in accordance with some embodiments.

Turing to FIG. 5, a prospective view of the first post 214 according to some embodiments is provided. In some embodiments, the first post 214 includes at least one of the first post section 302, the second post section 304, a third post section 330 or a fourth post section 332. In some embodiments, at least one of the fourth post section 332 is over the third post section 330, the third post section 330 is over the second post section 304 or the second post section 304 is over the first post section 302. In some embodiments, at least one of the post sections 302, 304, 330 or 332 have a first height 342. In some embodiments, the first height 242 is about 0.75 meters to about 2 meters. In some embodiments, the first post 214 has a second height 344. In some embodiments, the second height 344 is about 3 meters to about 7 meters.

In some embodiments, at least one of the first post section 302, the second post section 304, the third post section 330 or the fourth post section 332 includes at least one of the first intersection platform 312, the second intersection platform 314, the third intersection platform 316, the fourth intersection platform 318, a fifth intersection platform 334, a sixth intersection platform 336, a seventh intersection platform 338 or an end cap 340. In some embodiments, at least one of the first intersection platform 312 is attached to the waffle slab 320, the second intersection platform 314 is attached to the third intersection platform 316, the fourth intersection platform 318 is attached to the fifth intersection platform 334 of the sixth intersection platform 336 is attached to the seventh intersection platform 338. In some embodiments, the first post 214 includes an end cap 340. In some embodiments, the end cap 340 is configured to accommodate at least one of the vibration sensor 288*a*, illustrated in FIG. 2, or the truss support anchor 254*a*, illustrated in FIG. 2.

In some embodiments, the overhead crane 100 is configurable to accommodate many different working bay layouts or relayouts. In some embodiments, post sections are added or removed from each post to increase or decrease the overall height of the overhead crane 100. In some embodiments, the center span section is configurable to increase or decrease the overall width of the overhead crane 100. In some embodiments, the vacuum system prevents dust or other contaminates from interfering or contaminating the item of manufacture. In some embodiments, the overhead crane 100 protects against accidental collapse. In some embodiments, the overhead crane 100 is configurable to help manufacture at least one of 300 mm or 450 mm wafers. In some embodiments, the overhead crane is configurable to accommodate manufacturing components weighing up to 100 kg per hoist.

According to some aspects of the instant disclosure, an overhead crane is provided. The overhead crane comprises a first horizontal rail having a first end and a second end, a second horizontal rail having a third end and a fourth end, a first post connected to the first end of the first horizontal rail, a second post connected to the second end of the first horizontal rail, a third post connected to the third end of the second horizontal rail, a fourth post connected to the fourth end of the second horizontal rail and a cross member extending from the first horizontal rail to the second horizontal rail. The second horizontal rail is positioned parallel to and spaced apart from the first horizontal rail. The cross member comprises a center span section having a first side and a second side, a first side arm connecting the first horizontal rail to the first side of the center span section and a second side arm connecting the second horizontal rail to the second side of the center span section.

According to some aspects of the instant disclosure, an overhead crane is provided. The overhead crane comprises a first horizontal rail having a first end and a second end, a second horizontal rail having a third end and a fourth end, a first post connected to the first end of the first horizontal rail, a second post connected to the second end of the first horizontal rail, a third post connected to the third end of the second horizontal rail, a fourth post connected to the fourth end of the second horizontal rail, a cross member extending from the first horizontal rail to the second horizontal rail and a first moving wheel set. The second horizontal rail is positioned parallel to and spaced apart from the first horizontal rail. The cross member comprises a center span section being trapezoidialy shaped having a first side and a second side, a first side arm connecting the first horizontal rail to the first side of the center span section and a second side arm connecting the second horizontal rail to the second side of the center span section.

According to some aspects of the instant disclosure, an overhead crane is provided. The overhead crane comprises a first horizontal rail having a first end and a second end, a second horizontal rail having a third end and a fourth end, a first post connected to the first end of the first horizontal rail, a second post connected to the second end of the first horizontal rail, a third post connected to the third end of the second horizontal rail, a fourth post connected to the fourth end of the second horizontal rail, a cross member extending from the first horizontal rail to the second horizontal rail, a dust sensor, a vacuum pipeline, a moving wheel set, a retain wheel set and a first hoist. The second horizontal rail is positioned parallel to and spaced apart from the first horizontal rail. The cross member comprises a first side arm proximate the first horizontal rail, a second side arm proximate the second horizontal rail, a center span section having a first side and a second side, a first cable stay connected to the first side of the center span section and a second cable stay connected to the second side of the center span section. The center span section is located between the first side arm and the second side arm.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

Various operations of embodiments are provided herein. The order in which some or all of the operations are described should not be construed as to imply that these operations are necessarily order dependent. Alternative ordering will be appreciated given the benefit of this description. Further, it will be understood that not all operations are necessarily present in each embodiment provided herein. Also, it will be understood that not all operations are necessary in some embodiments.

Further, unless specified otherwise, "first," "second," or the like are not intended to imply a temporal aspect, a spatial aspect, an ordering, etc. Rather, such terms are merely used as identifiers, names, etc. for features, elements, items, etc. For example, a first channel and a second channel generally correspond to channel A and channel B or two different or two identical channels or the same channel.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application are generally be construed to mean "one or more" unless specified otherwise or clear from context to be directed to a singular form. Also, at least one of A and B or the like generally means A or B or both A and B. Furthermore, to the extent that "includes", "having", "has", "with", or variants thereof are used in either the detailed description or the claims, such terms are intended to be inclusive in a manner similar to the term "comprising".

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. An overhead crane comprising:

a first horizontal rail having a first end and a second end;

a second horizontal rail having a third end and a fourth end, the second horizontal rail positioned parallel to and spaced apart from the first horizontal rail;

a first post connected to the first end of the first horizontal rail;

a second post connected to the second end of the first horizontal rail;

a third post connected to the third end of the second horizontal rail;

a fourth post connected to the fourth end of the second horizontal rail; and a cross member extending from the first horizontal rail to the second horizontal rail comprising:

a center span section having a first side and a second side;

a first side arm connecting the first horizontal rail to the first side of the center span section; and a second side arm connecting the second horizontal rail to the second side of the center span section, wherein at least one of the first post or the second post comprises a first vibration sensor configured to sense a vibration and halt operation of a portion of the overhead crane when the vibration exceeds a vibration threshold.

2. The overhead crane of claim 1, wherein at least one of the first post, the second post, the third post or the fourth post comprises:

a first post section having a first intersection joint;

a second post section having a second intersection joint, the second post section positioned on top of the first post section; and a coupling member coupling the first intersection joint and the second intersection joint.

3. The overhead crane of claim 2, wherein a vacuum pipeline is contained within at least one of the first post, the second post, the third post or the fourth post.

4. The overhead crane of claim 1, comprising:

a first cable stay connected to the first side of the center span section; and a second cable stay connected to the second side of the center span section.

5. The overhead crane of claim 1, comprising:

a truss suspension system connecting at least one of the first post, the second post, the third post, the fourth post, the first horizontal rail or the second horizontal rail to at least one of a wall or a ceiling.

6. The overhead crane of claim 1, wherein the center span section is trapezoidal shaped.

7. The overhead crane of claim 1, comprising:

a first hoist connected to the cross member.

8. The overhead crane of claim 1, comprising:

a retain wheel set; and a moving wheel set.

9. The overhead crane of claim 8, wherein the moving wheel set is configured to move the cross member along at least one of the first horizontal rail or the second horizontal rail.

10. The overhead crane of claim 1, wherein at least one of the first post, the second post, the third post or the fourth post comprises:

a first post section having a first intersection joint;

a second post section having a second intersection joint, the second post section positioned on top of the first post section; and a coupling member coupling the first intersection joint and the second intersection joint.

11. The overhead crane of claim 1, comprising:

a second vibration sensor in optical communication with the first vibration sensor.

12. The overhead crane of claim 1, wherein at least one of the first post, the second post, the third post or the fourth post is anchored to a waffle slab.

13. An overhead crane comprising:

a first horizontal rail having a first end and a second end;

a second horizontal rail having a third end and a fourth end, the second horizontal rail positioned parallel to and spaced apart from the first horizontal rail;

a first post connected to the first end of the first horizontal rail;

a second post connected to the second end of the first horizontal rail;

a third post connected to the third end of the second horizontal rail;

a fourth post connected to the fourth end of the second horizontal rail;

a cross member extending from the first horizontal rail to the second horizontal rail comprising:

a center span section having a first side and a second side;

a first side arm connecting the first horizontal rail to the first side of the center span section; and a second side arm connecting the second horizontal rail to the second side of the center span section; and a cable stay connected to the first side of the center span section, wherein at least one of the first post or the second post comprises a first vibration sensor configured to sense a vibration and halt operation of a portion of the overhead crane when the vibration exceeds a vibration threshold.

14. The overhead crane of claim 13, wherein at least one of the first post, the second post, the third post or the fourth post comprises:

a first post section having a first intersection joint;

a second post section having a second intersection joint, the second post section positioned on top of the first post section; and a coupling member coupling the first intersection joint and the second intersection joint.

15. The overhead crane of claim 13, comprising:

a second vibration sensor in optical communication with the first vibration sensor.

16. The overhead crane of claim 13, comprising:

a truss suspension system connecting at least one of the first post, the second post, the third post, the fourth post, the first horizontal rail or the second horizontal rail to at least one of a wall or a ceiling.

17. The overhead crane of claim 13, comprising:

a first hoist connected to the cross member.

18. The overhead crane of claim 13, wherein a vacuum pipeline is comprised within at least one of the first post, the second post, the third post or the fourth post.

19. An overhead crane comprising:

a first horizontal rail having a first end and a second end;

a second horizontal rail having a third end and a fourth end, the second horizontal rail positioned parallel to and spaced apart from the first horizontal rail;

a first post connected to the first end of the first horizontal rail;

a second post connected to the second end of the first horizontal rail;

a third post connected to the third end of the second horizontal rail;

a fourth post connected to the fourth end of the second horizontal rail;

a cross member extending from the first horizontal rail to the second horizontal rail comprising:

a first side arm proximate the first horizontal rail;

a second side arm proximate the second horizontal rail; and a center span section having a first side and a second side, the center span section located between the first side arm and the second side arm;

a first cable stay connected to the first side of the center span section; and a second cable stay connected to the second side of the center span section;

a dust sensor;

a vacuum pipeline;

a moving wheel set;

a retain wheel set; and a first hoist.

20. The overhead crane of claim 19, wherein at least one of the first post, the second post, the third post or the fourth post comprises:

a first post section having a first intersection joint;

a second post section having a second intersection joint, the second post section positioned on top of the first post section; and a coupling member coupling the first intersection joint and the second intersection joint.

* * * * *